United States Patent [19]

Salzmann et al.

[11] Patent Number: 4,838,454

[45] Date of Patent: Jun. 13, 1989

[54] NAPKIN DISPENSER

[75] Inventors: Ferdinand F. Salzmann, Prairie du Sac; Gregory J. Wenkman, Middleton, both of Wis.

[73] Assignee: Traex Corporation, Dane, Wis.

[21] Appl. No.: 115,116

[22] Filed: Nov. 2, 1987

[51] Int. Cl.[4] ..... A47G 21/16; B65H 1/02

[52] U.S. Cl. ..... 221/57; 221/59; 221/279; 312/61

[58] Field of Search ..... 221/52, 56, 57, 59, 221/198, 227, 279; 312/61

[56] References Cited

U.S. PATENT DOCUMENTS

| | | | |
|---|---|---|---|
| D. 263,669 | 4/1982 | Collins | D7/72 |
| 3,203,586 | 8/1965 | Downham | 221/55 |
| 3,208,636 | 9/1965 | Filipowicz | 221/57 |
| 3,214,227 | 10/1965 | Filipowicz | 221/59 X |
| 3,370,748 | 2/1968 | Koerper et al. | 221/59 |
| 3,550,978 | 12/1970 | Magee | 312/108 |
| 4,329,001 | 5/1982 | Filipowicz et al. | 312/71 |

*Primary Examiner*—F. J. Bartuska

*Attorney, Agent, or Firm*—Quarles & Brady

[57] ABSTRACT

A napkin dispenser includes a drawer which slides in and out of a housing and a push plate which also slides in the housing and is spring biased to push the napkins forward. A pair of locks on the rear of the drawer in the preferred napkin dispenser push the plate forward when the drawer is open but pivot to release the push plate when the drawer is closed so that the napkins are not pressed too tightly, even if napkins are overloaded in the drawer when it is open. Similarly, a pair of locks on the push plate apparatus in the alternative napkin dispenser push the plate forward when the drawer is open but pivot to release the push plate when the drawer is closed.

19 Claims, 6 Drawing Sheets

NAPKIN DISPENSER

BACKGROUND OF THE INVENTION

1. Field of the Invention

The present invention relates to a napkin dispenser which receives, holds and dispenses a stack of folded napkins, which commonly is used on a counter or tabletop in lunchrooms or restaurants.

2. Description of the Prior Art

Currently, several different types of napkin dispensers are available on the market in which a drawer is used to hold a stack of identical napkins in position within a space to be removed by the user from the dispenser through an opening in the front panel. Generally the drawer fits into a cabinet or housing which encloses the stack of napkins. A spring biased plate urges the napkins to the front of the drawer so that they may be removed through the opening by the user. To load the dispenser, the user pulls the drawer forwardly from the housing, and inserts a stack of napkins into the drawer, and then pushes the drawer back into the housing. This type of napkin dispenser is shown generally in U.S. Pat. No. 3,214,227 to Filipowicz, U.S. Pat. No. 3,370,7482 Koerper et al., and U.S. Pat. No. 4,329,001 to Filipowicz et al.

Very often the individual refilling the napkin dispenser will overfill the dispenser, hoping that the dispenser will not have to be refilled again soon. However, problems often occur when napkin dispensers are overfilled. First, a user often will find it difficult to remove a napkin from the dispenser. Additionally, as the forwardmost napkin is being removed, very often the friction between the adjacent napkins will cause several napkins to come out of the dispenser, instead of just one. The U.S. Pat. No. 4,329,001 to Filipowicz et al. discloses a napkin dispenser which includes a lever pivotally mounted on the push plate which pivots downwardly when the drawer is moved forwardly in the housing, and upwardly when the drawer is closed. When the lever is in its upward position, the push plate is prevented from moving to its rearmost position. When the drawer is closed so that the lever is in its upward position, the push plate is allowed to move to its rearward position so that the space in which the napkins are stored increases, thereby decreasing the pressure on the napkins.

Nevertheless, there still remains a need for napkin dispeners which increase the space for napkins when the drawer is in its closed position, thereby making individual removal of napkins easy despite the overfilling of the napkin dispenser with a stack of napkins.

SUMMARY OF THE INVENTION

The present invention is summarized in that a napkin dispenser for receiving, holding and dispensing a stack of folded napkins includes a housing which has a top, a bottom, a rear, two side walls, and an open front; and at least one pair of inwardly extending flanges which are affixed to an interior face of each housing side wall, extending longitudinally along each side wall; a drawer having a space for containing the napkins, the drawer including a bottom wall, a rear wall, two side panels joined thereto, and a front face panel which is connected to the front of the bottom wall and the side panels, the front panel having an opening through which individual folded napkins may be removed; a push plate apparatus including a plate for pushing the stack of napkins forwardly toward the opening; and at least one spring which biases the plate apparatus to move forwardly. The flanges of a selected pair of inwardly extending flanges of the interior face of each housing side wall include a forward portion which is substantially horizontal, and a rearward portion which extends downwardly and rearwardly from the forward portion to form and include a lower horizontal portion. The drawer is slidable within the housing to move forwardly out through the open front and rearwardly so that the front face panel closes the open front. The drawer preferably further includes two pivotal locks which each are connected pivotally at a rear end thereof to the rear wall of the drawer to be pivoted between an up position and a down position. Each lock includes a front face, and two projections which extend outwardly from near the front face of the lock so that one projection overlies a flange of the selected pair of the flanes, and the other projection immediately underlies the same flange so that as the drawer opens and closes, the pivotable lock rides the flange between the projections. The push plate apparatus includes a plate for pushing the stack of napkins forwardly toward the opening, and a pair of rearwardly facing catch walls at the opposite sides of the plate. When the drawer is opened, the locks ride on the forward portion of the select pair of flanges causing the locks to be in their up positions to prevent rearward movement of the plate within the drawer beyond where each lock front face bears against the associated push plate catch wall. When the drawer is closed, the locks rise on the lower horizontal portions of the selected pair of flanges thereby causing the locks to be in their down positions to allow further rearward movement of the push plate in the drawer. Thus, when the drawer is fully closed, the push plate is allowed to move to its rearmost position, thereby expanding the space within the drawer for napkins.

Alternatively, each flange of a selected pair of inwardly extending flanges could include a forward flange portion which is substantially horizontal, and a rearward flange portion which curves upwardly and rearwardly from the forward flange portion. In such an embodiment, the push plate apparatus might include two pivotal locks which are each connected pivotally to opposite sides of the push plate apparatus to be pivoted vertically between an up position and a down position. Each such lock includes a rear face, and a projection which rides upon one of the selected flanges. When the drawer is open, the locks ride on the forward flange portions causing the locks to be in their down positions to prevent rearward movement of the plate apparatus within the drawer beyond where each lock rear face bears against the drawer rear wall. When the drawer is closed, the locks ride on the rearward flange portions causing the locks to be in their up positions with their rear faces above the drawer rear wall to allow further rearward movement of the push plate apparatus in the drawer to a rearmost position.

A primary object of the present invention is to provide a napkin dispenser having unitary molded plastic track members affixed to the interior face of the housing side walls.

A second object of the present invention is to provide a napkin dispenser having plastic track members formed from a material which causes little friction between the track members and the drawer and push plate.

Another object of the invention is to provide a napkin dispenser which when overfilled will still allow for proper removal of individual napkins.

An additional object of the invention is to provide a napkin dispeners which includes locks which allow the space for napkins to expand when the drawer is closed, wherein such locks are easily fabricated and assembled to the napkin dispenser drawer.

Other objects, features, and advantages of the invention will be apparent from the following detailed description taken in conjunction with the accompanying drawings wherein a preferred embodiment of the invention has been selected for exemplification.

DESCRIPTION OF THE PREFERRED EMBODIMENT

Figure 1:
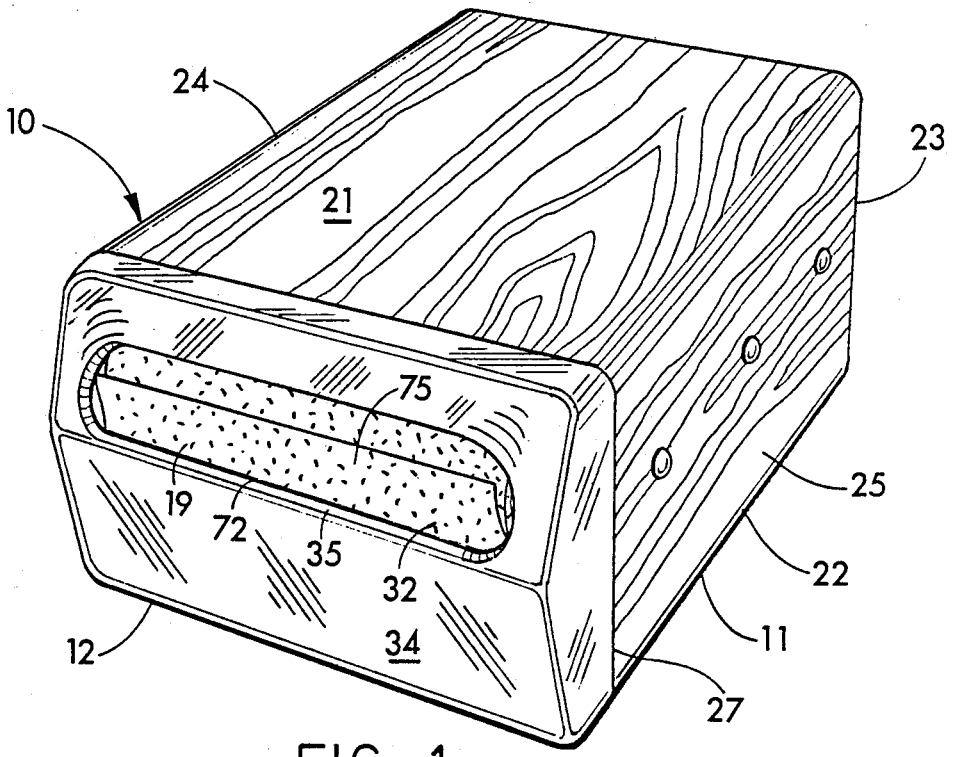
FIG. 1 is a perspective view of a preferred napkin dispenser according to the present invention.
Figure 2:
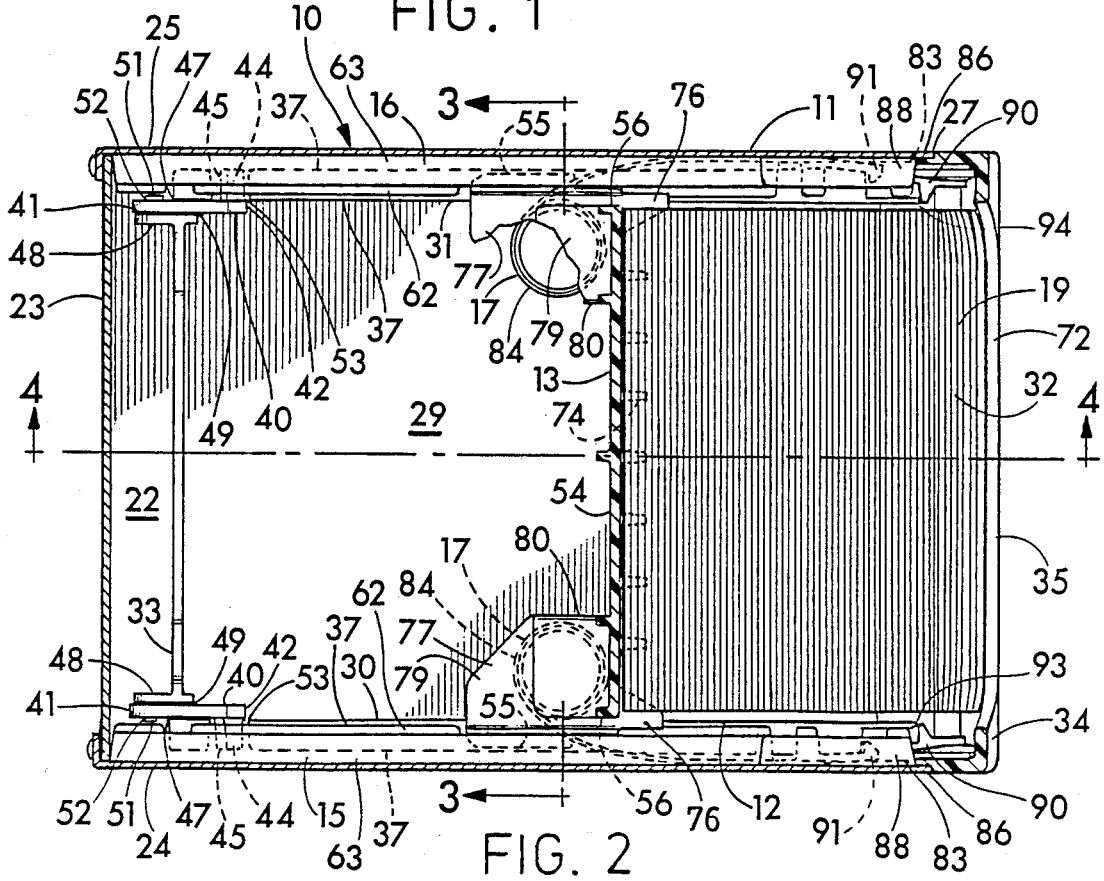
FIG. 2 is a top plan section view of the preferred napkin dispenser shown in FIG. 1.

Referring more particularly to the drawings, wherein like numbers refer to like parts, FIGS. 1 and 2 show a napkin dispenser 10 including a housing 11, a drawer 12, a preferred push plate apparatus 13, a pair of unitary molded track members 15 and 16, and two springs 17 which both bias the plate apparatus 13 to move forwardly to drive the napkins 19. The housing includes a top 21, a bottom 22, a rear 23, and two side walls 24 and 25 and has an open front 27.

Figure 3:
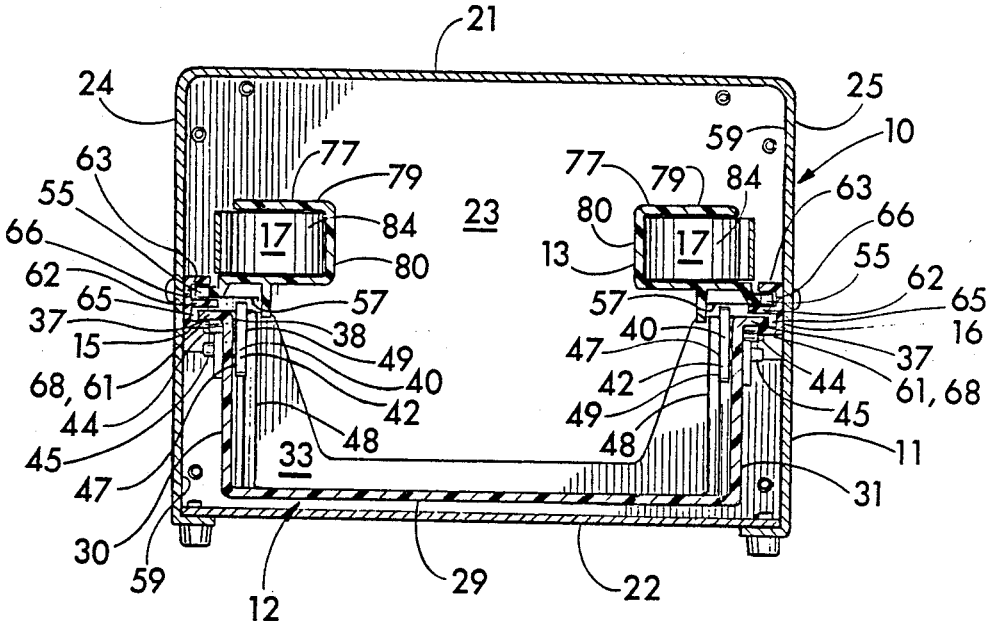
FIG. 3 is a cross section view taken along section line 3—3 of FIG. 2.
Figure 4:
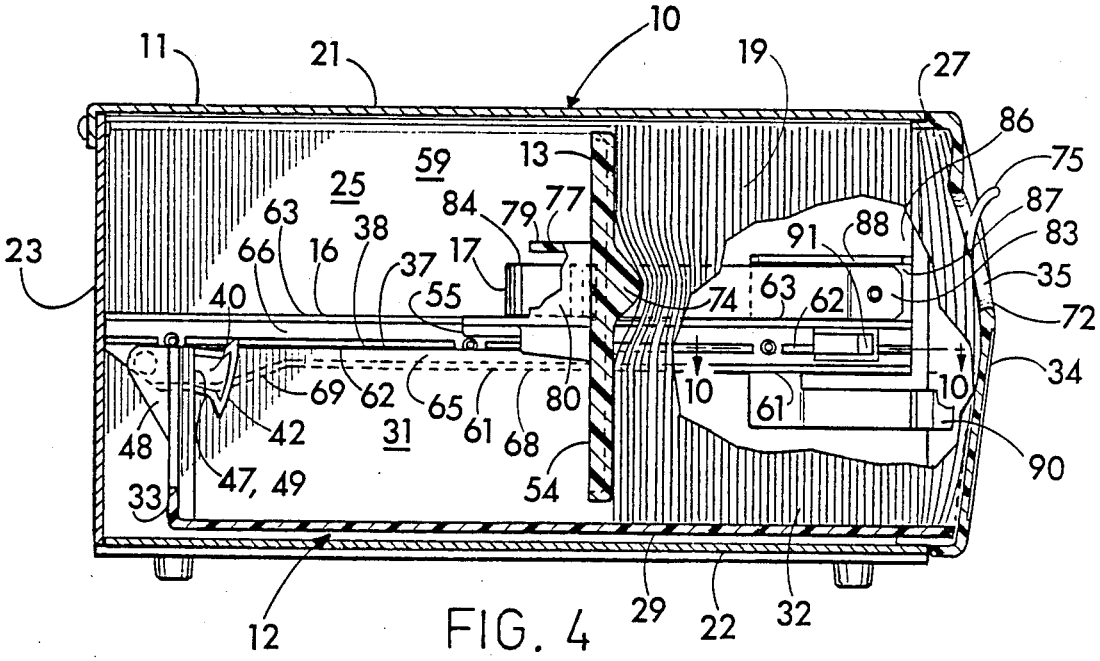
FIG. 4 is a longitudinal section view taken along section line 4—4 of FIG. 2.
Figure 8:
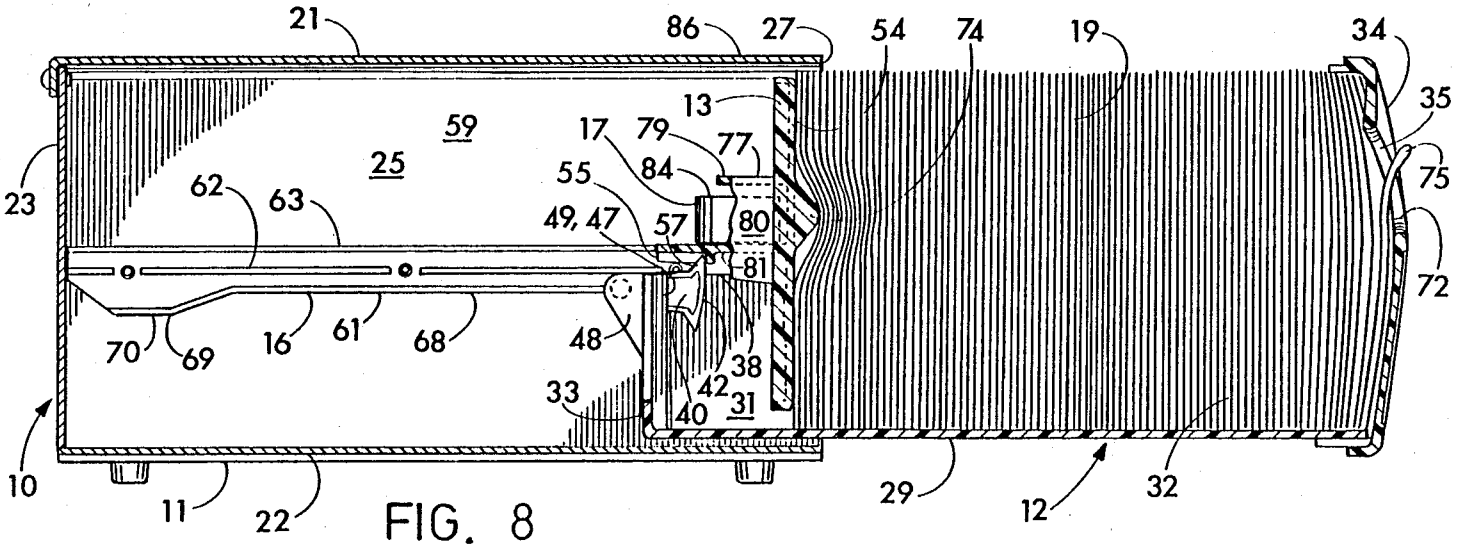
FIG. 8 is a longitudinal section view similar to that shown in FIG. 4, except that the drawer is in its open position and is filled with a stack of napkins.
Figure 9:
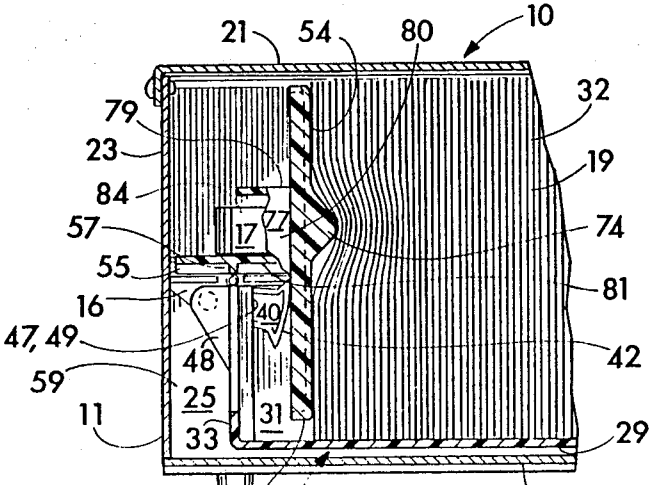
FIG. 9 is a partial longitudinal section view similar to part of that shown in FIG. 8, except that the drawer is shown in its closed position with the pressure plate apparatus in its rearmost position.
Figure 11:
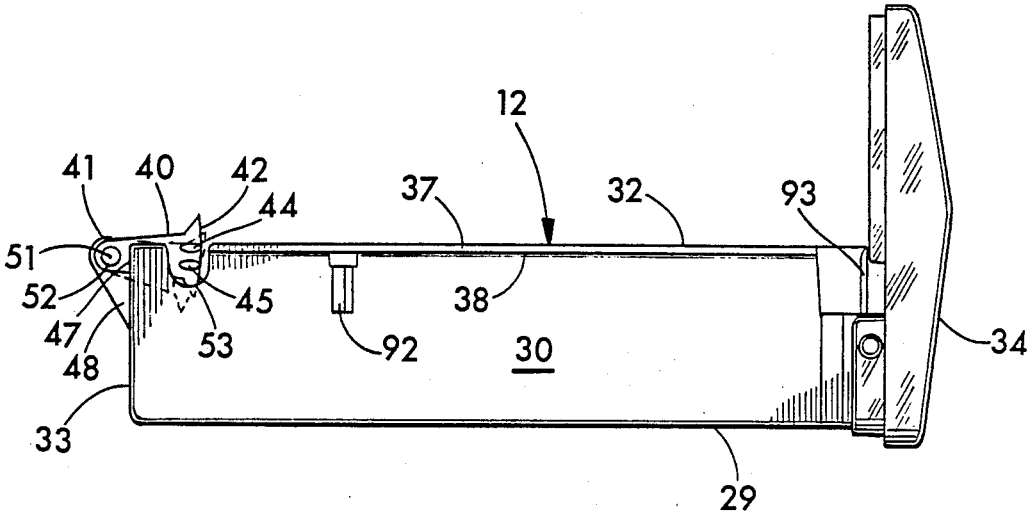
FIG. 11 is a side view of the drawer, showing the lock in its down position in dashed lines.

As shown in FIGS. 2–4, 8–9 and 11, the drawer 12 for containing the napkins 19 includes a bottom wall 29, two side panels 30 and 31, a rear wall 33, and a front face panel 34 having an opening 35 through which the napkins 19 are withdrawn by a user. The drawer 12 and push plate apparatus 13 together form a spacer 32 for containing the napkins 19. The front face panel 34 is bowed forwardly in an upper direction below the lower margin 72 of the opening 35 as shown in FIGS. 1 and 4. The front face panel 34 is also bowed rearwardly in an upward direction above the lower margin 72 of the opening 35. Each drawer side panel 30 or 31 includes an outwardly extending flange 37 at the upper edge 38 thereof. The drawer 12 slides with relation to the housing 11 so that it moves forwardly out through the open front 27 and rearwardly so that the front face panel 34 closes the open front 27 when the drawer 12 is in its closed position. The drawer 12 of the preferred napkin dispenser 10 further includes two pivotal locks 40 which each are connected pivotally at a rear end 41 thereof to the rear wall 33 of the drawer 12 so as to be pivotable between an up position and a down position, as shown in FIGS. 8, 9 and 11. Each lock 40 includes a front face 42, and upper and lower projections 44 and 45 which both extend outwardly near the front face 42 of each of the pivotal locks 40. The function of these pivotal locks 40 will be discussed below. The rear wall 33 of the drawer of the drawer 12 has formed in it two narrow slots 47 which each open upwardly and are each located adjacent to a drawer side panel 30 or 31 as shown in FIG. 3. The rear wall 33 includes two tabs 48 which each extend rearwardly from an inward side 49 of one of the slots 47 so as to be spaced inwardly and rearwardly from the adjacent side panel 30 or 31, yet oriented parallel to the side panels 30 and 31 as shown in FIGS. 2–4. Each tab 48 includes a connected peg 51 which extends outwardly. Each lock 40 has a hole 52 at the rear end 41 of the lock through which one of the pegs 51 extends so that the lock 40 can pivot around the peg 51. Each side panel 30 or 31 has a notch 53, seen best in FIG. 11, which opens upwardly through the outwardly extending flange 37 near the drawer rear wall 33. The upper and lower projections 44 and 45 of each lock 40 extend outward through one of these notches 53, and move up and down within the notch 53 as the lock 40 pivots up and down.

Figure 5:
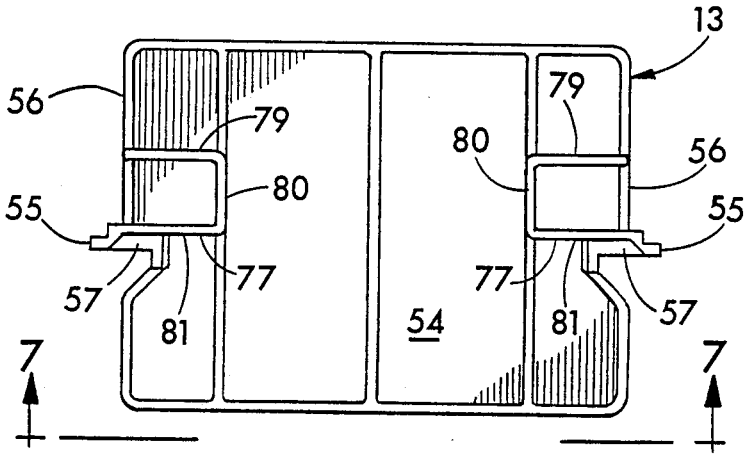
FIG. 5 is a rear view of the push plate apparatus of the preferred napkin dispenser.
Figure 6:
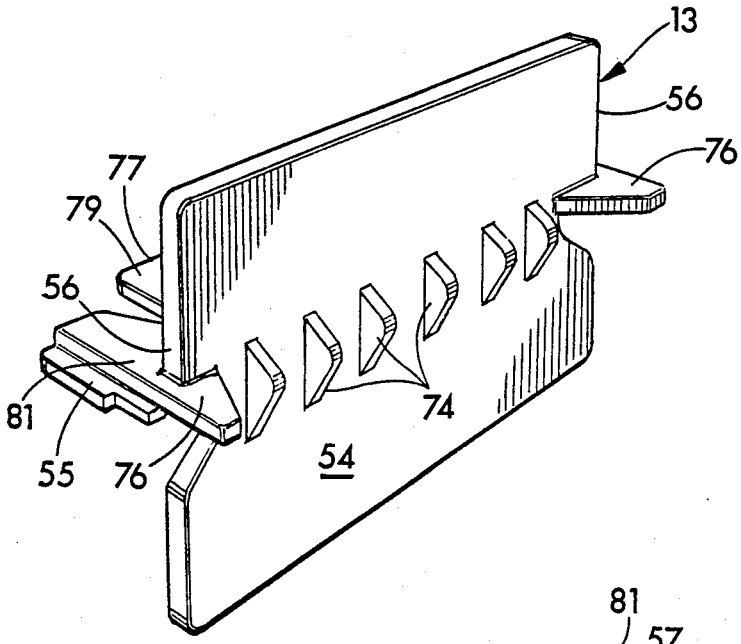
FIG. 6 is a perspective view of the push plate apparatus showing the front and side thereof.
Figure 7:
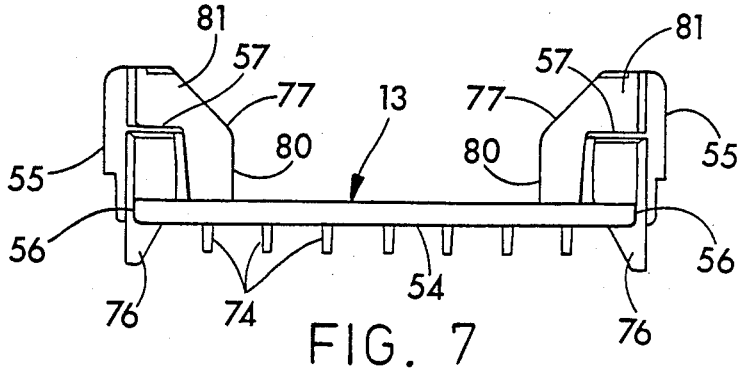
FIG. 7 is a bottom plan view of the push plate apparatus.

The push plate apparatus 13 of the preferred napkin dispenser 10 includes a plate 54 for pushing the stack of napkins 19 forwardly toward the opening 35, two slides 55 which are connected to opposite sides 56 of the plate apparatus 13, and which extend horizontally outwardly therefrom, and two rearwardly facing catch walls 57 also located at the opposite sides 56 of the plate apparatus 13 as shown in FIGS. 2–4. The push plate 13 itself is shown in FIGS. 5–7. The push plate 13 includes vertical fins 74 which project forwardly from the plate 54, and are horizontally equally spaced from one another, and which are positioned substantially below the opening 35 in the front face panel 34. The vertical fins 74 function to push the napkins 19 into the bowed front panel 34 so that the front pull flap 75 of the forwardmost napkin 19 extends up into the opening 35 so that the forwardmost napkin 19 can be pulled easily through the opening by the user. Two horizontal fins 76 project forwardly from the plate 54 near the opposite sides 56 of the plate apparatus 13. The horizontal fins 76 are tapered inwardly and rearwardly so that they act to center napkins 19 in front of the plate 54. The push plate apparatus 13 further includes two coil housings 77 which project rearwardly from opposite sides 56 of the plate apparatus 13 above and to the inward side of the drawer side panels 30 and 31 as shown in FIGS. 2–4. Each housing 77 includes a top wall 79, an inside wall 80, and a lower wall 81 which are joined together. Each catch wall 57 preferably descends from the lower wall 81 of one of the coil housings 77.

Each track member 15 or 16 is affixed to an interior face of one of the housing side walls 24 or 25 and extends longitudinally along the side wall 24 or 25. A track member 15 or 16 includes three inwardly extending flanges 61, 62, and 63 which are parallel to one another for most of their length and which form a lower slot 65 and an upper slot 66. The right track member 16 is shown most clearly in FIGS. 3–4 and 8. The left track member 15 is identical to the right track member 16, except it is the mirror image thereof. One drawer side panel flange 37 fits into each lower slot 65 to allow the drawer to ride on the lowermost inwardly extending flange 61 so that the drawer slides forwardly and rearwardly between an open position, and a closed position where the drawer front panel 34 substantially closes the open front 27 of the housing 11. This flange 37 within a slot 65 engagement also prevents lateral and vertical movement of the drawer 12. One push plate slide 55 fits into the upper slot 66 of each track member 15 or 16 so that the plate apparatus 13 rides above the middlemost inwardly extending flange 62 thus allowing the plate apparatus 13 to slide forwardly and rearwardly within the drawer 12. The uppermost flange 63 overlies the slide 55 to prevent lateral and vertical movement of the plate apparatus 13.

When the preferred napkin dispenser 10 is assembled properly, each pivotal lock 40 is entrained on the lowermost inwardly extending flange 61 so that the upper projection 44 overlies the lowermost flange 61, and the lower projection 45 immediately underlies the lowermost flange 61. As the drawer 12 opens and closes, the pivotal lock 40 pivots so that the projections 44 and 45 track on the lowermost flange 61 as it goes up or down. The lowermost flange 61 of each track member 15 or 16 includes a forward portion 68 which together with the adjacent middlemost flange 62 forms the lower slot 65. Thus the drawer 12, when opening and closing, actually rides on the forward portion 68 of the lowermost flanges 61. In the preferred napkin dispenser 10, the lowermost flanges 61 each further include a rearward portion 69 and extend downwardly and rearwardly from the forward portion 68 to form and include a lower horizontal portion 70. When the drawer 12 is at least partially open, the locks 40 ride on the forward portions 68 of the lowermost flanges 61 thereby causing the locks 40 to be in their up positions as shown in FIG. 8. When the locks 40 are in their up positions, the plate apparatus 13 can only be moved rearwardly within the drawer 12 to where the lock front faces 42 abut against the catch walls 57 on the plate apparatus 13. On the other hand, when the drawer 12 is moved to its closed position, the locks 40 ride on the lower horizontal portions 70 of the lowermost flanges 61, thereby causing the locks 40 to be pivoted to their down positions. With the locks 40 in their down position, the front faces 42 of the locks 40 are positioned downwardly out of the way of the plate apparatus catch walls 57 so that the push plate apparatus 13 is free to move to its rearmost position within the drawer 12 as shown in FIG. 9.

The two coiled springs 17 each have a front end 83 which is secured near the forward end 86 of the housing 11 above the inwardly extending flanges 61, 62, and 63. As shown in FIG. 4, track member 15 or 16 includes an appendage 87 which extends upwardly above the uppermost inwardly extending flange 63 near the forward end 86 of the housing 11. The front end 83 of each coiled spring 17 is permanently affixed to the appendage 87. Each appendage 87 includes an upper lip 88 which together with the uppermost flange 63 prevents the coil springs 17 from pivoting in a vertical direction. The coiled portion 84 of the spring 17 is maintained within a coil housing 77 behind the plate 54 so that the coiled portion 84 bears against the plate 54 to thereby bias the plate 54 to move forwardly as shown in FIGS. 2 and 4.

In its operation, the preferred napkin dispenser 10 is intended to be used to dispense napkins conveniently from a location on a counter or tabletop in a lunchroom. To remove a single napkin 19 from the dispenser 10, a user simply grasps the front pull flap 75 and pulls it out through the opening 35 in the front face panel 34. Only one napkin 19 should thereby be removed from the dispenser 10 at a time.

Figure 10:
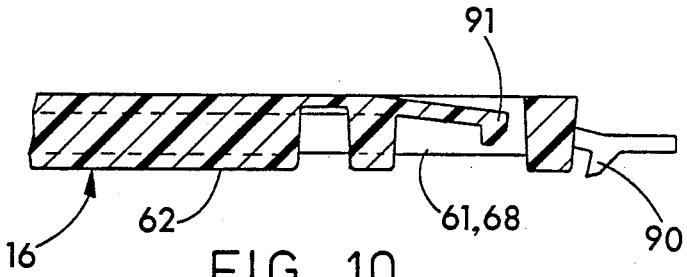
FIG. 10 is a section view taken along section line 10—10 of FIG. 4.

When it is desired to refill the napkin dispenser 10, the following procedure is used. First, the person filling the dispenser simply places his/her index fingers in through the opening 35 to press the levers 90 outwardly, thereby releasing the drawer 14 so that it may then be pulled forwardly to its open position as shown in FIG. 8. As shown in FIG. 2, the levers 90 normally block the drawer 14 from opening by catching at least one front edge 93 or 94 of one or more of the drawer side panels 30 or 31. As shown in FIG. 11, the front edge 93 of the left side panel 30 is beveled so that the adjacent lever 90 need not be released to open the drawer 14 in the preferred dispenser 10. The front edge 94 of the right side panel 31 is square, however, so the adjacent lever 90 must be released. As the drawer 14 opens, the push plate apparatus 13 will move forwardly only to the open front 27 of the housing 11 because the apparatus slides 55 will be prevented from further forward movement by the stops 91. As shown in FIGS. 4 and 10, each lever 90 and stop 91 is molded as part of a track member 15 or 16. The drawer 14 will only move forwardly to its open position where the levers 90 prevent further forward movement of the drawer 14 by catching small projections 92 which each extend outwardly from one of the drawer side panels 30 or 31. The projections 92 are shown most clearly in FIG. 11. Once the drawer 12 is opened, a stack of napkins 19 can be placed in the space 32 provided for the napkins. The person refilling the stack of napkins 19 into the drawer 12 should make sure that a front pull flap 75 of the forwardmost napkin 19 extends upwardly through the opening 35. When the drawer 12 is in its open position, that space 32 is limited rearwardly by the action of the locks 40 in their up position preventing the plate apparatus from moving to its rearmost position within the drawer 12. Once the space 32 is filled with a stack of napkins, the drawer 12 may be pushed back to its closed position. Then when the drawer 12 is in its closed position, the locks 40 pivot downwardly to their down position, thereby allowing the push plate apparatus 13 to move its rearmost position within the drawer 12. The space 32 for containing the napkins 19 then expands, thereby lessening the pressure between adjacent napkins 19 within the stack. This decrease in pressure makes it more likely that the user will be able to easily obtain only one napkin 19 at a time from the dispenser 10.

Figure 12:
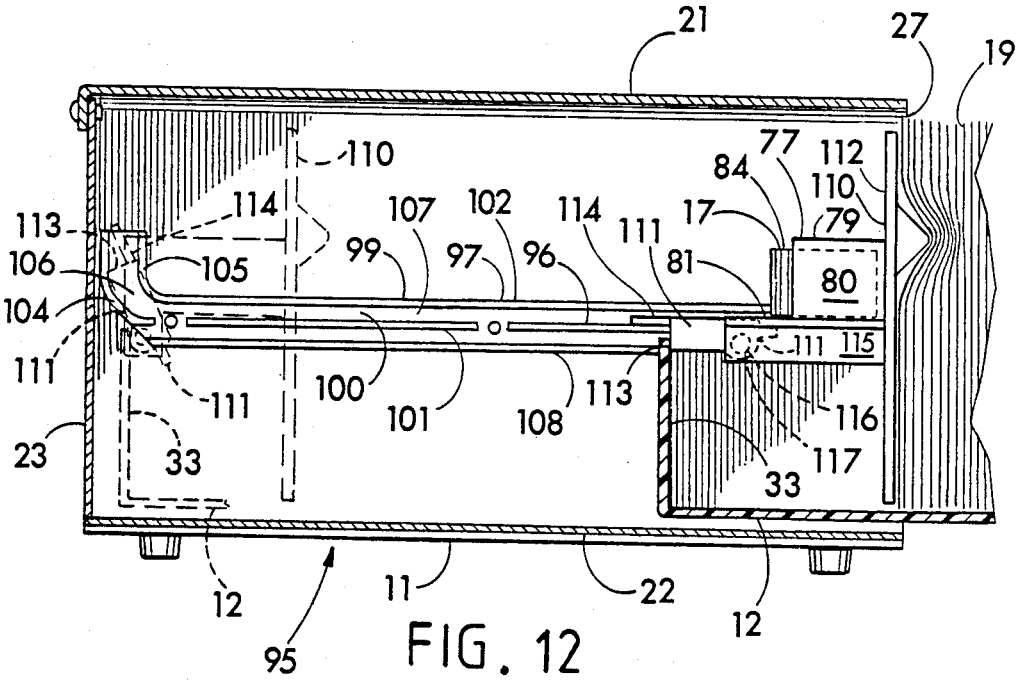
FIG. 12 is a longitudinal section view of an alternative embodiment of the napkin dispenser, the section line being similar to that which defines FIG. 8.

In an alternative embodiment of the invention, the pivotal locks instead could be placed on the push plate apparatus to bear against the rear wall of the drawer. FIG. 12 shows an example of such an embodiment. As shown, the alternate napkin dispenser 95 is similar to the preferred napkin dispenser 10, but with the following differences. The middlemost and uppermost inwardly extending flanges 96 and 97 of the track member 99 form a slot 100 and include forward flange portions 101 and 102 which are substantially horizontal, and rearward flange portions 104 and 105 which curve upwardly and rearwardly from the forward flange portions 101 and 102 to form a rearward portion 106 of the slot 100 which curves upwardly and rearwardly from the forward portion 107 of the slot 100. The lowermost inwardly extending flange 108 is substantially horizontal.

The push plate apparatus 110 includes two pivotal locks 111 which are each pivotally connected to opposite sides 112 of the plate apparatus 110 to be pivoted vertically between an up position and a down position. Each lock 111 includes a rear face 113 and a projection 114 which extends outwardly to overlie the middlemost flange 96 and to ride in the slot 100 as the drawer 12 opens and closes. A support wall 115 depends from the lower wall 81 of the coil housing 77, and includes a peg 116 on which one of the pivotal locks 111 is mounted pivotally. Each pivotal lock 111 has a hole 117 into which the peg 116 fits so that the lock 111 can pivot around the peg 116. FIG. 12 shows only the right side of the alternate napkin dispenser 95. The left side would be substantially the mirror image of that shown.

From the perspective of the user, the alternate napkin dispenser 95 operates quite similarly as the preferred dispenser 10. However, when the drawer 12 is opened, the lock projections 114 ride in the forward portions 107 of the slot 100, over the middlemost forward flange portions 101 so that the locks 111 are in their down position. As shown in FIG. 12, when the locks 111 are in their down position, their rear faces 113 come to abut and press against the drawer rear wall 33, preventing the push plate apparatus 110 from moving any further rearwardly. When the drawer 12 is closed as shown partially in dashed lines in FIG. 12, the lock projections 114 ride in the rearward portions 106 of the slots 100 over the middlemost rearward flange portions 104 so that the locks 111 are in their up positions. As shown in dashed lines, the rear faces 113 of the locks 111 are lifted above the drawer rear wall 33 so that the push plate apparatus 110 can move further rearwardly to its rearmost position within the drawer 12. Thus, pressure between adjacent napkins 19 within the alternate dispenser 95 is relieved so that only one napkin 19 at a time is dispensed through the opening 35.

It is to be understood that the present invention is not limited to the particular arrangements and embodiments of parts disclosed and illustrated herein, nor to the materials specified, but embraces all such modified forms thereof as come within the scope of the following claims.

What is claimed is:

1. A napkin dispenser for receiving, holding and dispensing a stack of folded napkins, the dispenser comprising:

(a) a housing which includes a top, a bottom, a rear and two side walls, and which has an open front;

(b) a drawer for containing the napkins, the drawer including a bottom wall; two side panels joined thereto, the drawer side panels including outwardly extending flanges at their upper edges; a front face panel which is connected to the front of the bottom wall and the side panels, the front panel having an opening through which individual folded napkins may be removed; a rear wall; and two pivotal locks which are each connected pivotally at a rear end thereof to the rear wall of the drawer to be pivoted vertically between an up position and a down position, each lock including a front face;

(c) a push plate apparatus including a plate for pushing the stack of napkins forwardly toward the opening; two slides which are connected to opposite sides of the plate apparatus and which extend outwardly therefrom; and two rearwardly facing catch walls at the opposite sides of the plate apparatus;

(d) a pair of unitary molded track members which are each affixed to an interior face of one of the housing walls to extend longitudinally along the side wall, each track member including three inwardly extending flanges which are parallel to the adjacent flanges for most of their length and which form a lower slot and an upper slot, the drawer side panel flanges received in the lower slots to allow the drawer to slide forwardly and rearwardly between an open position and a closed position where the drawer front panel substantially closes the open front of the housing, the plate apparatus slides received in the upper slots to allow the plate apparatus to slide forwardly and rearwardly within the drawer and to prevent lateral and vertical movement of the plate apparatus, each lock entrained on a lowermost flange of the three inwardly extending flanges so that as the drawer opens and closes, the pivotal lock rides on the lowermost flange, the lowermost flange including a forward portion which with a middlemost flange of the three inwardly extending flanges forms the lower slot, and a rearward portion which extends downwardly and rearwardly from the forward portion to form and include a lower horizontal portion, wherein when the drawer is open, the locks ride on the forward portions of the lowermost flanges causing the locks to be in their up positions to prevent rearward movement of the plate apparatus within the drawer beyond where each lock front face bears against the associated push plate catch wall, wherein when the drawer is closed, the locks ride on the lower horizontal portions of the lowermost flanges causing the locks to be in their down positions to allow further rearward movement of the push plate apparatus in the drawer to a rearmost position; and (e) at least one spring which biases the plate apparatus to move forwardly.

2. The dispenser of claim 1 wherein each pivotal lock includes two projections which extend outwardly from each lock above and below the lowermost flange to thereby entrain the lock on the lowermost flange, and the rear wall of the drawer forms two narrow slots which each open upwardly and are located adjacent to a drawer side panel, and the rear wall includes two tabs which extend rearwardly from inward sides of the narrow slots so as to be spaced inwardly from the side panels, each pivotal lock being pivotally connected to one tab and being able to pivot to extend forwardly through the associated narrow slot between the tab and the adjacent side wall, the side panels each having a notch which opens upwardly through the outwardly extending flange to allow the two projections on the pivotal lock extend therethrough to engage and ride the lowermost flange.

3. The dispenser of claim 1 wherein the front panel is bowed forwardly in an upward direction below a lower margin of the opening, and is bowed rearwardly in an upward direction above the lower margin, and wherein the push plate apparatus further includes vertical fins which project forwardly from the plate, the vertical fins being horizontally equally spaced from one another and substantially being located below the opening in the front panel, the vertical fins being adapted to push the napkins into the bowed front panel so that a front pull flap of the forwardmost napkin extends up into the opening so it can be pulled easily through the opening.

4. The dispenser of claim 1 wherein there are two coiled springs which bias the push plate apparatus to move forwardly, each coil spring having a front end which is affixed near a forward end of the housing above the inwardly extending flanges, and wherein the push plate apparatus includes two coil housings which project rearwardly from opposite sides of the plate above the drawer side panels, each housing including a top wall, an inside wall and a lower wall which are joined together and which maintain a coiled portion of one spring in position behind the plate so that the coiled portion bears against the plate to thereby bias the plate to move forwardly.

5. A napkin dispenser for receiving, holding and dispensing a stack of folded napkins, the dispenser comprising:

(a) a housing which includes a top, a bottom, a rear and two side walls, and which has an open front;

(b) a drawer for containing the napkins, the drawer including a bottom wall, two side panels joined thereto and a front face panel which is connected to the front of the bottom wall and the side panels, the front panel having an opening through which individual folded napkins may be removed, the drawer side panels including outwardly extending flanges at their upper edges;

(c) a push plate apparatus including a plate for pushing the stack of napkins forwardly toward the opening, two slides which are connected to opposite sides of the plate apparatus and which extend outwardly therefrom, and two horizontal fins which project forwardly from the plate near the opposite sides of the apparatus, the horizontal fins being tapered inwardly and rearwardly so that they guide napkins to be centered in front of the plate;

(d) a pair of unitary molded track members which are each affixed to an interior face of one of the housing walls to extend longitudinally along the side wall, each track member including three inwardly extending flanges which are parallel to the adjacent flanges for most of their length and which form a lower slot and an upper slot, the drawer side panel flanges received in the lower slots to allow the drawer to slide forwardly and rearwardly between the open position and a closed position where the drawer front panel substantially closes the open front of the housing, the plate apparatus slides received in the upper slots to allow the plate apparatus to slide forwardly and rearwardly within the drawer and to prevent lateral and vertical movement of the plate apparatus; and (e) at least one spring which biases the plate apparatus to move forwardly.

6. A napkin dispenser for receiving, holding and dispensing a stack of folded napkins, the dispenser comprising:

(a) a housing which includes a top, a bottom, a rear and two side walls, and which has an open front;

(b) a drawer for containing the napkins, the drawer including a bottom wall; two side panels joined thereto, the drawer side panels including outwardly extending flanges at their upper edges; a front face panel which is connected to the front of the bottom wall and the side panels, the front panel having an opening through which individual folded napkins may be removed; and a rear wall which is joined to the bottom wall and side panels;

(c) a push plate apparatus including a plate for pushing the stack of napkins forwardly toward the opening; two slides which are connected to opposite sides of the plate apparatus and which extend outwardly therefrom; and two pivotal locks which each are connected pivotally to opposite sides of the plate apparatus to be pivoted vertically between an up position and a down position, each lock including a rear face;

(d) a pair of unitary molded track members which are each affixed to an interior face of one of the housing walls to extend longitudinally along the side wall, each track member including three inwardly extending flanges which are parallel to the adjacent flanges for most of their length and which form a lower slot and an upper slot, the drawer side panel flanges received in the lower slots to allow the drawer to slide forwardly and rearwardly between an open position and a closed position where the drawer front panel substantially closes the open front of the housing, the plate apparatus slides received in the upper slots to allow the plate apparatus to slide forwardly and rearwardly within the drawer and to prevent lateral and vertical movement of the plate apparatus, each lock entrained within one of the slots between two flanges so that as the drawer opens and closes, the pivotal lock rides within that slot; the two flanges, which form the slot within which the lock rides, including forward flange portions which form a forward portion of the slot which is substantially horizontal, and rearward flange portions which curve upwardly and rearwardly from the forward flange portions to form a rearward portion of the slot which curves upwardly and rearwardly from the forward portion of the slot; wherein when the drawer is open, each lock rides within the forward portion of the slot causing the locks to be in their down positions to prevent rearward movement of the plate apparatus within the drawer beyond where each lock rear face bears against the drawer rear wall, wherein when the drawer is closed, each lock rides within the rearward portion of the slot causing the locks to be in their up positions with their rear faces above the drawer rear wall to allow further rearward movement of the push plate apparatus in the drawer to a rearmost position; and (e) at least one spring which biases the plate apparatus to move forwardly.

7. The dispenser of claim 6 wherein there are two coiled springs which bias the push plate apparatus to move forwardly, and wherein the push plate apparatus includes two coil housings which project rearwardly from opposite sides of the plate above the drawer side panels, each housing including a top wall, an inside wall and a lower wall which are joined together and which maintain a coiled portion of one spring in position behind the plate.

8. The dispenser of claim 7 wherein the push plate apparatus includes a support wall which depends from the lower wall of the coil housing, the support wall including a peg on which one of the pivotal locks is pivotally mounted, and wherein each pivotal lock includes a projection which extends outwardly into the slot in which the lock rides.

9. A napkin dispenser for receiving, holding and dispensing a stack of folded napkins, the dispenser comprising:

(a) a housing which includes a top, a bottom, a rear, and two side walls, and which has an open front;

(b) at least one pair of inwardly extending flanges which are affixed to an interior face of each housing side wall, the flanges of a selected pair of flanges each including a forward flange portion which is substantially horizontal, and a rearward flange portion which curves upwardly and rearwardly from the forward flange portion;

(c) a drawer for containing the napkins, the drawer including a bottom wall, a rear wall, two side panels joined thereto, and a front face panel which is connected to the front of the bottom wall and the side panels, the front panel having an opening through which individual folded napkins may be removed, the drawer being slidable within the housing to move forwardly out through the open front and rearwardly so that the front face panel closes the open front;

(d) a push plate apparatus including a plate for pushing the stack of napkins forwardly toward the opening, and two pivotal locks which each are connected pivotally to opposite sides of the plate apparatus to be pivoted vertically between an up position and down position, each lock including a rear face, and a projection which extends outwardly to overlie a flange of the selected pair of flanges so that as the drawer opens and closes, the pivotal lock rides the flange with its projection, wherein when the drawer is open, the locks ride on the forward flange portions of the select pair of flanges causing the locks to be in their down positions to prevent rearward movement of the plate apparatus within the drawer beyond where each lock rear face bears against the drawer rear wall, wherein when the drawer is closed, the locks ride on the rearward flange portions of the select pair of flanges causing the locks to be in their up positions with their rear faces above the drawer rear wall to allow further rearward movement of the push plate apparatus in the drawer to a rearmost position; and (e) at least one spring which biases the plate apparatus to move forwardly.

10. The dispenser of claim 9 wherein there are two coiled springs which bias the push plate apparatus to move forwardly, and wherein the push plate apparatus includes two coil housings which project rearwardly from opposite sides of the plate above the drawer side panels, each housing including a top wall, an inside wall and a lower wall which are joined together and which maintain a coiled portion of one spring in position behind the plate.

11. The dispenser of claim 10 wherein the push plate apparatus includes a support wall which depends from the lower wall of the coil housing, the support wall including a peg on which one of the pivotal locks is pivotally mounted.

12. The dispenser of claim 9 wherein the front panel is bowed forwardly in an upward direction below a lower margin of the opening, and is bowed rearwardly in an upward direction above the lower margin, and wherein the push plate apparatus further includes vertical fins which project forwardly from the plate, the vertical fins being horizontally equally spaced from one another and substantially being located below the opening in the front panel, the vertical fins being adapted to push the napkins into the bowed front panel so that a front pull flap of the forwardmost napkin extends up into the opening so it can be pulled easily through the opening.

13. The dispenser of claim 9 wherein the push plate apparatus further includes two horizontal fins which project forwardly from the plate near the opposite sides of the apparatus, the horizontal fins being tapered inwardly and rearwardly so that they guide napkins to be centered in front of the plate.

14. The dispenser of claim 9 wherein there are two coiled springs which bias the push plate apparatus to move forwardly, each coil spring having a front end which is affixed near a forward end of the housing above the inwardly extending flanges, and wherein the push plate apparatus includes two coil housings which project rearwardly from opposite sides of the plate above the drawer side panels, each housing including a top wall, an inside wall and a lower wall which are joined together and which maintain a coiled portion of one spring in position behind the plate so that the coiled portion bears against the plate to thereby bias the plate to move forwardly.

15. A napkin dispenser for receiving, holding and dispensing a stack of folded napkins, the dispenser comprising:

(a) a housing which includes a top, a bottom, a rear, and two side walls, and which has an open front;

(b) at least one pair of inwardly extending flanges which are affixed to an interior face of each housing side wall, extending longitudinally along each side wall, the flanges of a selected pair of flanges each including a forward portion which is substantially horizontal, and a rearward portion which extends downwardly and rearwardly from the forward portion to form and include a lower horizontal portion;

(c) a drawer for containing the napkins, the drawer including a bottom wall, a rear wall, two side panels joined thereto, and a front face panel which is connected to the front of the bottom wall and the side panels, the front panel having an opening through which individual folded napkins may be removed, the drawer being slidable within the housing to move forwardly out through the open front and rearwardly so that the front face panel closes the open front, the drawer further including two pivotal locks which each are connected pivotally at a rear end thereof to the rear wall of the drawer to be pivoted between an up position and a down position, each lock including a front face, and two projections which extend outwardly from near a front end of the lock so that one projection overlies a flange of the selected pair of flanges, and the other projection immediately underlies the same flange so that as the drawer opens and closes, the pivotal lock straddles and rides the flange between the projections;

(d) a push plate apparatus including a plate for pushing the stack of napkins forwardly toward the opening, and a pair of rearwardly facing catch walls at opposite sides of the plate apparatus, wherein when the drawer is open, the locks ride on the forward portions of the select pair of flanges causing the locks to be in their up positions to prevent rearward movement of the plate apparatus within the drawer beyond where each lock front face bears agains the associated push plate catch wall, wherein when the drawer is closed, the locks ride on the lower horizontal portions of the selected pair of flanges causing the locks to be in their down positions to allow further rearward movement of the push plate apparatus in the drawer to a rearmost position; and (e) at least one spring which biases the plate apparatus to move forwardly.

16. The dispenser of claim 15 wherein the rear wall of the drawer forms two narrow slots which each open upwardly and are located adjacent to a drawer side panel, and the rear wall includes two tabs which extend rearwardly from inward sides of the narrow slots so as to be spaced inwardly from the side panels, each pivotal lock being pivotally connected to one tab and being able to pivot to extend forwardly through the associated narrow slot between the tab and the adjacent side wall, the side panels each having a notch which opens upwardly through the outwardly extending flange to allow the two projections on the pivotal lock extend therethrough to engage and ride the lowermost flange.

17. The dispenser of claim 15 wherein the front panel is bowed forwardly in an upward direction below a lower margin of the opening, and is bowed rearwardly in an upward direction above the lower margin, and wherein the push plate apparatus further includes vertical fins which project forwardly from the plate, the vertical find being horizontally equally spaced from one another and substantially being located below the opening in the front panel, the vertical fins being adapted to push the napkins into the bowed front panel so that a front pull flap of the forwardmost napkin extends up into the opening so it can be pulled easily through the opening.

18. The dispenser of claim 15 wherein the push plate apparatus further includes two horizontal fins which project forwardly from the plate near the opposite sides of the apparatus, the horizontal fins being tapered inwardly and rearwardly so that they guide napkins to be centered in front of the plate.

19. The dispenser of claim 15 wherein there are two coiled springs which bias the push plate apparatus to move forwardly, each coil spring having a front end which is affixed near a forward end of the housing above the inwardly extending flanges, and wherein the push plate apparatus includes two coil housings which project rearwardly from opposite sides of the plate above the drawer side panels, each housing including a top wall, an inside wall and a lower wall which are joined together and which maintain a coiled portion of one spring in position behind the plate so that the coiled portion bears against the plate to thereby bias the plate to move forwardly.

* * * * *